US008917185B1

(12) United States Patent
Brano

(10) Patent No.: US 8,917,185 B1
(45) Date of Patent: Dec. 23, 2014

(54) APPLIANCE ALARM ASSEMBLY

(71) Applicant: Jan Brano, Hamden, CT (US)

(72) Inventor: Jan Brano, Hamden, CT (US)

( * ) Notice: Subject to any disclaimer, the term of this patent is extended or adjusted under 35 U.S.C. 154(b) by 213 days.

(21) Appl. No.: 13/736,405

(22) Filed: Jan. 8, 2013

(51) Int. Cl.
*G08B 21/00* (2006.01)
*G08B 13/02* (2006.01)

(52) U.S. Cl.
CPC ..... *G08B 13/02* (2013.01)
USPC ..... 340/644; 340/540; 70/177; 126/351.1; 126/373.1; 126/42

(58) Field of Classification Search
CPC ..... F24C 15/36; F24C 3/124; F24C 3/12; F24C 15/12; A47J 37/0676; A47J 37/0682; A47J 37/0694; A47J 37/0713
USPC ..... 340/644, 643, 540; 126/39 A, 39 B, 126/39 BA, 39 C, 39 E, 39 F, 39 H, 39 N, 39 J, 126/39 K, 39 L, 39 M, 52, 40, 41 R, 351.1; 70/178, 174, 179, 177
See application file for complete search history.

(56) References Cited

U.S. PATENT DOCUMENTS

| | | | | | |
|---|---|---|---|---|---|
| 3,527,200 | A | * | 9/1970 | Voeke et al. | 126/42 |
| 3,789,823 | A | * | 2/1974 | Doskocil | 126/42 |
| 4,134,386 | A | * | 1/1979 | Miguel | 126/42 |
| 4,625,708 | A | * | 12/1986 | Beall | 126/42 |
| 4,922,888 | A | | 5/1990 | Bryan et al. | |
| D347,550 | S | | 6/1994 | Boone | |
| 5,615,667 | A | * | 4/1997 | Seeley et al. | 126/42 |
| 6,012,445 | A | | 1/2000 | Santelli, Jr. | |
| 6,371,105 | B1 | * | 4/2002 | Merritt | 126/42 |
| 6,932,595 | B1 | * | 8/2005 | Booker | 431/153 |
| 7,401,610 | B1 | | 7/2008 | Cherry | |
| 2011/0100486 | A1 | | 5/2011 | Brewton, III et al. | |

* cited by examiner

*Primary Examiner* — George Bugg
*Assistant Examiner* — Edny Labbees

(57) ABSTRACT

An appliance alarm assembly indicates unauthorized use of an appliance. The assembly includes a cover having a first wall and a perimeter wall coupled to and extending from the first wall defining an enclosed interior space. An attachment member is coupled to the cover for coupling the cover to an appliance such that the cover is positioned over a control panel of the appliance. A pressure switch is coupled to the cover and includes a sensor arm extending outwardly from the cover. The pressure switch is tripped by movement of the sensor arm. The pressure switch activates an alarm coupled to the cover upon the pressure switch being tripped by movement of the sensor arm.

11 Claims, 3 Drawing Sheets

APPLIANCE ALARM ASSEMBLY

BACKGROUND OF THE DISCLOSURE

Field of the Disclosure

The disclosure relates to alarm devices and more particularly pertains to a new alarm device for indicating unauthorized use of an appliance.

SUMMARY OF THE DISCLOSURE

An embodiment of the disclosure meets the needs presented above by generally comprising a cover having a first wall and a perimeter wall coupled to and extending from the first wall defining an enclosed interior space. An attachment member is coupled to the cover for coupling the cover to an appliance such that the cover is positioned over a control panel of the appliance. A pressure switch is coupled to the cover and includes a sensor arm extending outwardly from the cover. The pressure switch is tripped by movement of the sensor arm. The pressure switch activates an alarm coupled to the cover upon the pressure switch being tripped by movement of the sensor arm.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
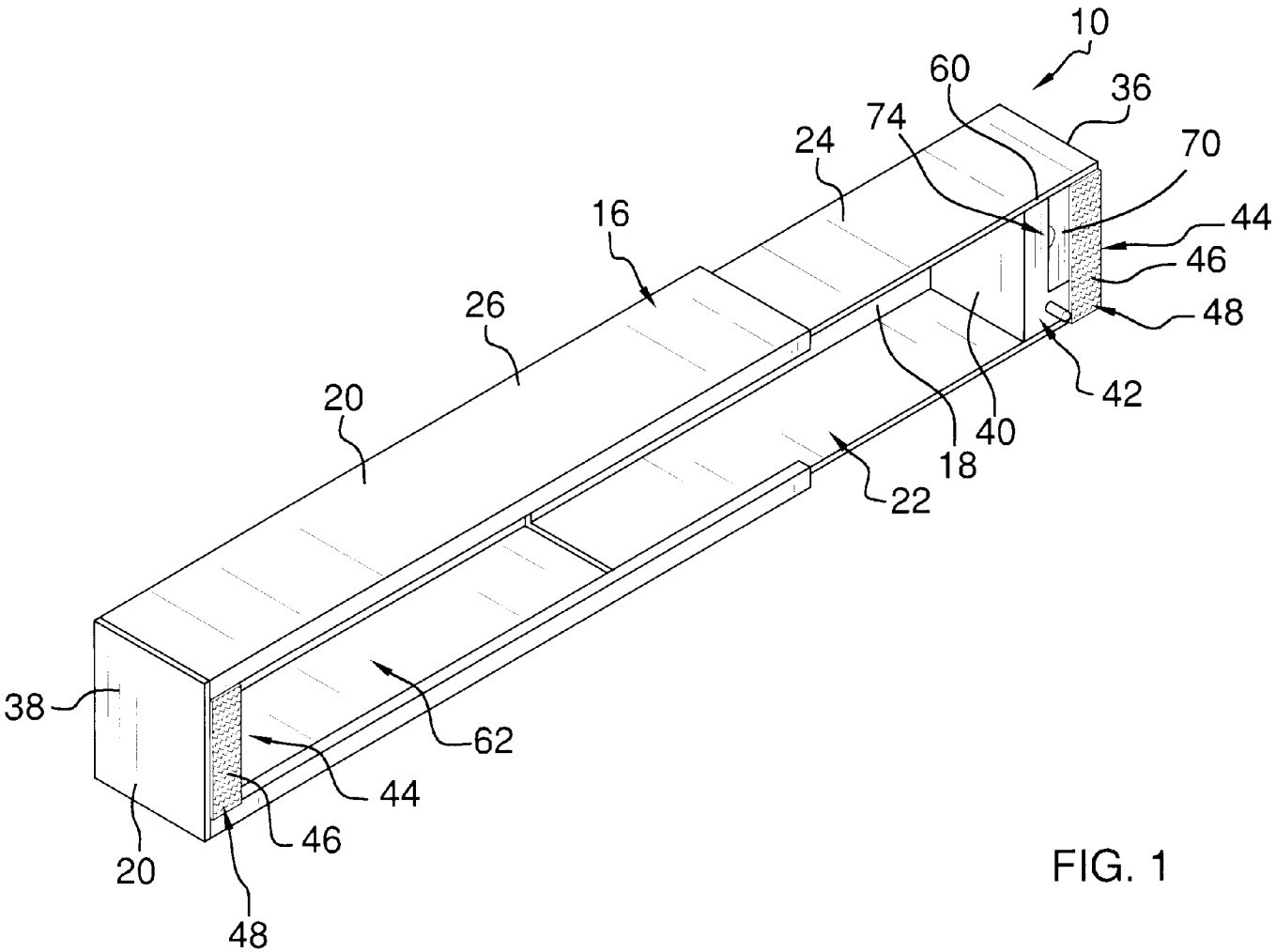
FIG. 1 is a top back side perspective view of a appliance alarm assembly according to an embodiment of the disclosure.
Figure 2:
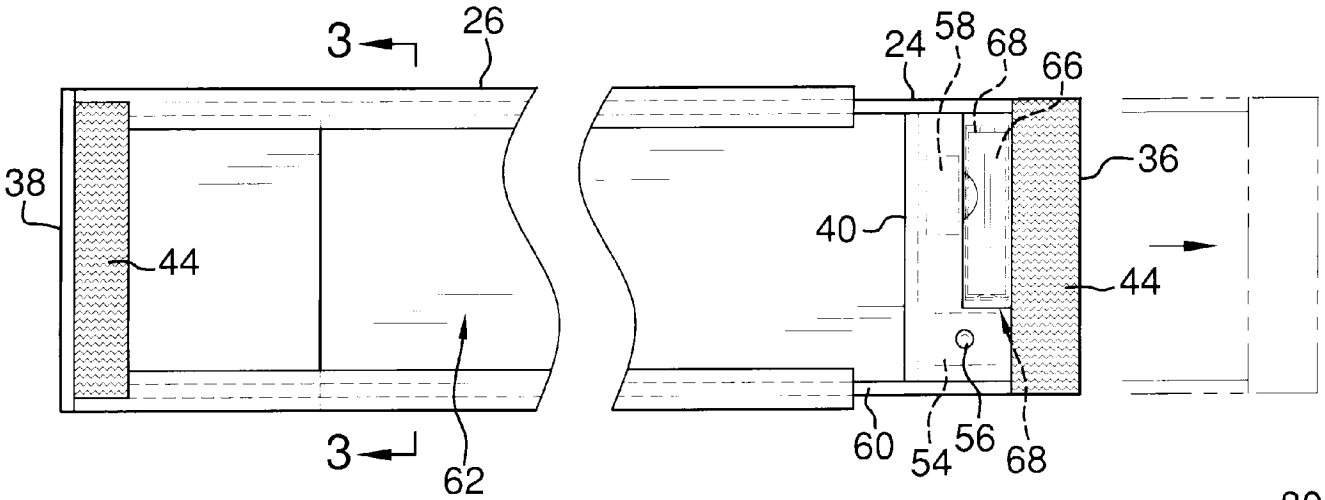
FIG. 2 is a back view of an embodiment of the disclosure.

With reference now to the drawings, and in particular to FIGS. 1 through 4 thereof a new alarm device embodying the principles and concepts of an embodiment of the disclosure and generally designated by the reference numeral 10 will be described.

Figure 3:
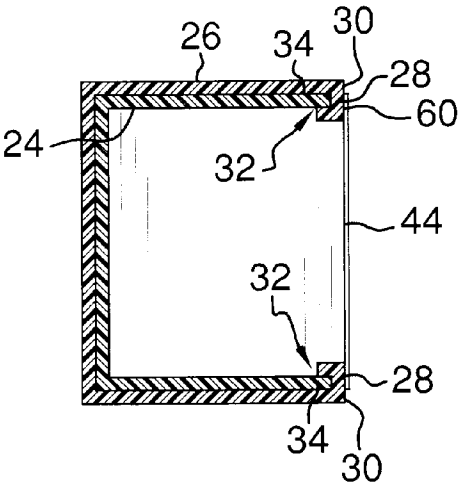
FIG. 3 is a cross-sectional view of an embodiment of the disclosure taken along line 3-3 of FIG. 2.
Figure 4:
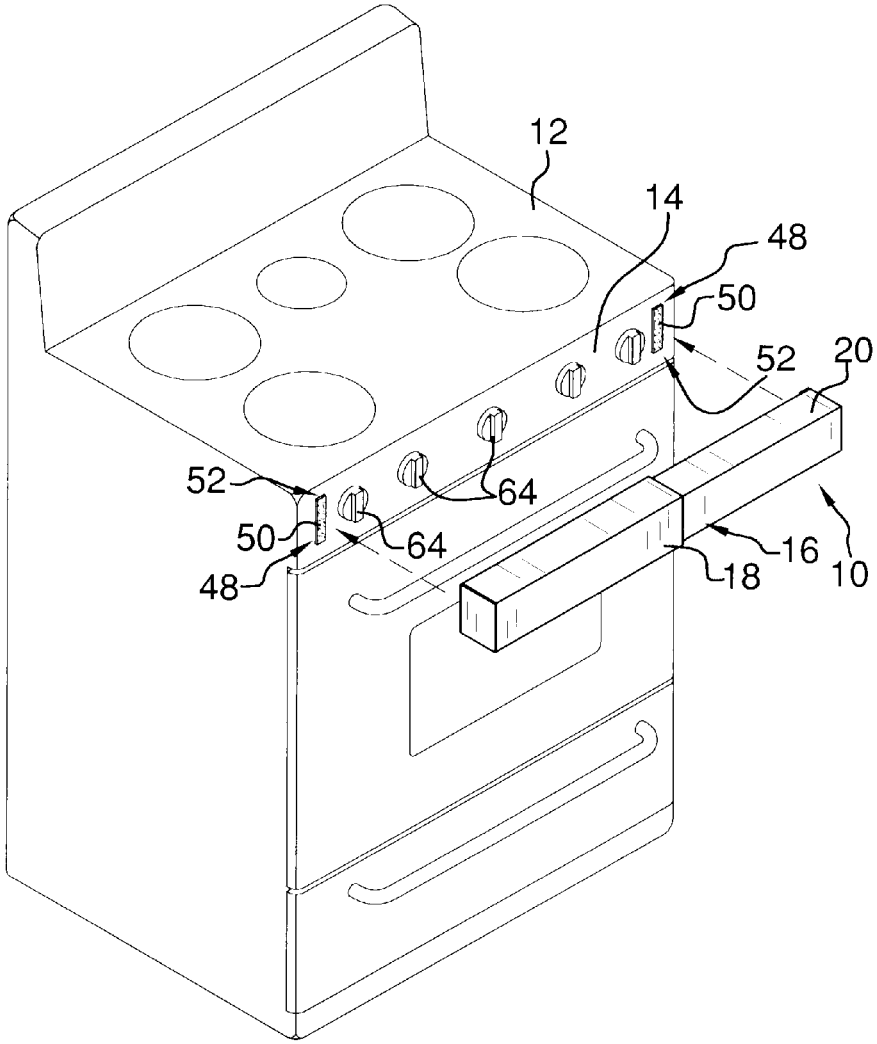
FIG. 4 is a partially exploded top front side view of an embodiment of the disclosure in use.

As best illustrated in FIGS. 1 through 4, the appliance alarm assembly 10 is configured to attach to an appliance 12 such that the assembly 10 covers a control panel 14 of the appliance 12. The assembly 10 generally comprises a cover 16 having a first wall 18 and a perimeter wall 20 coupled to and extending from the first wall 18. The first wall 18 and perimeter wall 20 define an enclosed interior space 22 wherein the cover 16 is configured for positioning over the control panel 14 restricting access to the control panel 14. The cover 16 comprises a first section 24 slidably coupled to a second section 26 wherein a length of the cover 16 is adjustable. As shown in FIG. 3, each of a pair of lips 28 extends from an associated distal edge 30 of the second section 26 of the cover 16 relative to the first wall 18. The lips 28 define a pair of spaced tracks 32. Distal edges 34 of the first section 24 of the cover 16 relative to the first wall 18 are positioned in the tracks 32. Thus, the first section 24 of the cover 16 is slidably coupled to the second section 26 of the cover 16. The cover 16 further has a first end 36 and a second end 38. The cover 16 includes an interior wall 40 defining a housing 42 in the interior space 22 adjacent to the first end 36 of the cover 36.

A pair of attachment members 44 is coupled to the cover 16. Each attachment member 44 is configured for coupling the cover 16 to the appliance 12 such that the cover 16 is positioned over the control panel 14 of the appliance 12. Each attachment member 44 is coupled to an associated one of the first section 24 of the cover 16 and the second section 26 of the cover 16. Thus, the attachment members 44 inhibit sliding of the first section 24 of the cover 16 relative to the second section 26 of the cover 16 when the cover 16 is coupled to the appliance 12. Each attachment member 44 is a first portion 46 of hook and loop fastener 48. A pair of second portions 50 of hook and loop fastener 48 each have a rear surface 52 configured for coupling to the appliance 12 adjacent to opposite ends of the control panel 14. Each second portion 50 of hook and loop fastener 48 is complimentary to an associated one of the first portions 46 of hook and loop fastener 48 wherein the cover 16 is couplable to the appliance 12 by engaging the first portions 46 of hook and loop fastener 48 to the second portions 50 of hook and loop fastener 48.

A pressure switch 54 is coupled to the cover 16 and positioned in the housing 42. The pressure switch 54 has a sensor arm 56 extending outwardly from the cover 16 to contact the appliance 12 when the cover 16 is coupled to the appliance 12. The switch 54 is tripped by movement of the sensor arm 56 when the cover 16 is moved or contacted with force exceeding a pre-determined threshold based on the movement of the sensor arm 56. An alarm 58 is coupled to the cover 16 and positioned in the housing 42. The alarm 58 is operationally coupled to the pressure switch 54 wherein the pressure switch 54 activates the alarm 58 upon the pressure switch 54 being tripped by movement of the sensor arm 56 as described above. The alarm 58 may be audible or provide a signal to an extrinsic device to produce an audible, visual, or other form of signal indicating the cover 16 has contacted sufficient to trip the pressure switch 54.

A distal edge 60 of the perimeter wall 20 relative to the first wall 18 defines an opening 62 into the interior space 22 wherein the cover 16 is configured for positioning over knobs 64 extending from the appliance 12. Thus, the knobs 64 extend through the opening 62 into the interior space 22 and are inaccessible until the cover 16 is removed from the appliance 12.

A battery 66 is coupled to the cover 16 and positioned in the housing 42. The battery 66 is electrically coupled to the alarm 58 and may also be coupled to the pressure switch 54 if the pressure switch 54 is of a type requiring an electrical current to operate. A battery compartment 68 is positioned in the housing 42 and the battery 66 is positioned in the battery compartment 68. A door 70 is coupled to the housing 42 selectively covering an access opening 74 into the battery compartment 68.

In use, the cover 16 is coupled to the appliance 12, such as an oven, stove, dishwasher, clothes washer, or the like, in a position covering the control panel 14 of the appliance 12 to effectively prevent operation of the appliance 12. Further movement or pressure on the cover 16 triggers the pressure switch 54 resulting in activation of the alarm 58. Thus, the appliance 12 cannot be used by a person such as a child or disabled adult, without the alarm 58 being triggered to alert others of potentially dangerous or unauthorized use of the appliance 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An appliance alarm assembly for restricting access to a control panel of an appliance and providing an alert when a person attempts to access the control panel, the assembly comprising:

a cover having a first wall and a perimeter wall coupled to and extending from said first wall defining an enclosed interior space wherein said cover is configured for positioning over the control panel;

an attachment member coupled to said cover, said attachment member being configured for coupling said cover to the appliance such that said cover is positioned over the control panel of the appliance;

a pressure switch coupled to said cover, said pressure switch having a sensor arm extending outwardly from said cover, said switch being tripped by movement of said sensor arm; and an alarm coupled to said cover, said alarm being operationally coupled to said pressure switch wherein said pressure switch activates said alarm upon said pressure switch being tripped by movement of said sensor arm.

2. The assembly of claim 1, further comprising a distal edge of said perimeter wall relative to said first wall defining an opening into said interior space wherein said cover is configured for positioning over knobs extending from the appliance such that the knobs extending through the opening into said interior space.

3. The assembly of claim 1, further comprising said cover comprising a first section slidably coupled to a second section wherein a length of said cover is adjustable.

4. The assembly of claim 1, further comprising:

said attachment member being a first portion of hook and loop fastener; and a second portion of hook and loop fastener having a rear surface configured for coupling to the appliance adjacent to the control panel, said second portion of hook and loop fastener being complimentary to said first portion of hook and loop fastener wherein said cover is couplable to the appliance by engaging said first portion of hook and loop fastener to said second portion of hook and loop fastener.

5. The assembly of claim 1, further comprising a battery coupled to said cover, said battery being electrically coupled to said alarm.

6. The assembly of claim 1, further comprising:

said cover having a first end and a second end; and said cover including an interior wall defining a housing in said interior space adjacent to said first end of said housing, said pressure switch and said alarm being positioned in said housing.

7. The assembly of claim 6, further comprising a battery coupled to said cover, said battery being electrically coupled to said alarm, said battery being positioned in said housing.

8. The assembly of claim 7, further comprising:

a battery compartment positioned in said housing, said battery being positioned in said battery compartment; and a door coupled to said housing selectively covering an access opening into said battery compartment.

9. The assembly of claim 3, further comprising:

a pair of lips, each lip extending from an associated distal edge of said second section of said cover relative to said first wall, said lips defining a pair of spaced tracks; and distal edges of said first section of said cover relative to said first wall being positioned in said tracks wherein said first section of said cover is slidably coupled to said second section of said cover.

10. The assembly of claim 3, further comprising a pair of said attachment members, each attachment member being coupled to an associated one of said first section of said cover and said second section of said cover wherein said attachment members inhibit sliding of said first section of said cover relative to said second section of said cover when said cover is coupled to the appliance.

11. An appliance alarm assembly for restricting access to a control panel of an appliance and providing an alert when a person attempts to access the control panel, the assembly comprising:

a cover having a first wall and a perimeter wall coupled to and extending from said first wall defining an enclosed interior space wherein said cover is configured for positioning over the control panel, said cover comprising a first section slidably coupled to a second section wherein a length of said cover is adjustable, said cover having a first end and a second end, said cover including an interior wall defining a housing in said interior space adjacent to said first end of said housing;

a pair of attachment members coupled to said cover, each said attachment member being configured for coupling said cover to the appliance such that said cover is positioned over the control panel of the appliance, each said attachment member being coupled to an associated one of said first section of said cover and said second section of said cover wherein said attachment members inhibit sliding of said first section of said cover relative to said second section of said cover when said cover is coupled to the appliance, each said attachment member being a first portion of hook and loop fastener;

a pair of second portions of hook and loop fastener each having a rear surface configured for coupling to the appliance adjacent to the control panel, each said second portion of hook and loop fastener being complimentary to an associated one of said first portions of hook and loop fastener of said attachment members wherein said cover is couplable to the appliance by engaging said first portions of hook and loop fastener to said second portions of hook and loop fastener;

a pressure switch coupled to said cover, said pressure switch having a sensor arm extending outwardly from said cover, said switch being tripped by movement of said sensor arm, said pressure switch being positioned in said housing;

an alarm coupled to said cover, said alarm being operationally coupled to said pressure switch wherein said pressure switch activates said alarm upon said pressure switch being tripped by movement of said sensor arm, said alarm being positioned in said housing;

a distal edge of said perimeter wall relative to said first wall defining an opening into said interior space wherein said cover is configured for positioning over knobs extending from the appliance such that the knobs extending through the opening into said interior space;

a battery coupled to said cover, said battery being electrically coupled to said alarm, said battery being positioned in said housing;

a battery compartment positioned in said housing, said battery being positioned in said battery compartment;

a door coupled to said housing selectively covering an access opening into said battery compartment;

a pair of lips, each lip extending from an associated distal edge of said second section of said cover relative to said first wall, said lips defining a pair of spaced tracks; and distal edges of said first section of said cover relative to said first wall being positioned in said tracks wherein said first section of said cover is slidably coupled to said second section of said cover.

* * * * *